United States Patent [19]

Beasley et al.

[11] 4,428,418

[45] Jan. 31, 1984

[54] HEAT EXCHANGER FIN ELEMENT WITH FOLDED OVER SIDE EDGES

[75] Inventors: Marvin D. Beasley; Wayne G. Blystone; Gerald W. Lemmon, all of Mount Vernon, Ill.

[73] Assignee: Chromalloy American Corporation, St. Louis, Mo.

[21] Appl. No.: 378,727

[22] Filed: May 17, 1982

[51] Int. Cl.[3] ..... F28F 1/32

[52] U.S. Cl. ..... 165/76; 165/129; 165/182; 165/DIG. 9

[58] Field of Search ..... 165/129, 182, 76, DIG. 9

[56] References Cited

U.S. PATENT DOCUMENTS

| | | | |
|---|---|---|---|
| 1,800,448 | 4/1931 | Henshall | 165/182 |
| 1,829,241 | 10/1931 | Shurtleff | 165/129 |
| 1,907,036 | 5/1933 | Belleau | 165/182 |
| 2,400,157 | 5/1946 | Merry . | |
| 2,516,871 | 8/1950 | Haugen | 165/129 |
| 2,602,650 | 7/1952 | Marcotte | 165/182 |
| 2,899,178 | 8/1959 | Dubin et al. | 165/182 |
| 3,089,016 | 5/1963 | Kelly | 165/182 X |
| 3,212,572 | 10/1965 | Otto | 165/166 |
| 3,478,821 | 11/1969 | Fieni | 165/182 |
| 3,881,455 | 5/1975 | Belsanti | 123/119 |
| 4,036,288 | 7/1977 | Neveux | 165/69 |
| 4,195,687 | 4/1980 | Taziker | 165/129 |

FOREIGN PATENT DOCUMENTS

| | | | |
|---|---|---|---|
| 2413766 | 10/1974 | Fed. Rep. of Germany | 165/182 |
| 1219296 | 5/1960 | France | 165/129 |
| 1354273 | 1/1964 | France | 165/182 |
| 304272 | 2/1930 | United Kingdom | 165/182 |
| 628704 | 9/1949 | United Kingdom | 165/182 |
| 2076519 | 12/1981 | United Kingdom | 165/182 |

*Primary Examiner*—Sheldon J. Richter

*Attorney, Agent, or Firm*—Haverstock, Garrett & Roberts

[57] ABSTRACT

A heat exchanger core assembly adaptable for allowing the passage of air therethrough comprising a plurality of fin elements extending in spaced apart parallel fashion across a plurality of fluid carrying tube members, each of the fin elements being positioned within the core assembly so as to have opposite side edges extending in a direction substantially parallel to the direction of air flow through the core assembly, each fin element including a folded over side portion extending along each of the opposite side edges thereof, the fin elements being stackable one upon the other such that the folded over side portions of one fin element mate with the folded over side portions of an adjacent fin element thereby forming a continuous, uninterrupted, substantially air tight core side on each opposite side of the plurality of mated together fin elements for substantially preventing the leakage of air therethrough. These folded over fin side portions may be configured to merely butt up against adjacent fins or to overlap and/or interlock therewith.

9 Claims, 13 Drawing Figures

PRIOR ART

HEAT EXCHANGER FIN ELEMENT WITH FOLDED OVER SIDE EDGES

The present invention relates to a heat exchanger core construction adaptable for use on turbo-charged internal combustion engines and, more particularly, to a cooling fin construction having means associated therewith for effectively sealing and preventing the flow of incoming air to the core assembly from leaking past a portion or portions of the heat exchanger core. The present invention resides in a removable heat exchanger core construction having cooling fins with folded over side edges which lie substantially parallel to the direction of air flow. When the cooling fins are stacked one upon the other as the core unit is assembled, the folded over fin edges associated therewith form continuous, uninterrupted, air tight core sides which form a controlled flow channel for the passage of air therethrough. These fin edges may be configured to merely butt up against adjacent fins or, more desirably, to overlap and/or interlock therewith. Coolant fluid passages extend longitudinally through the core unit and the cooling fins, which are spaced along the entire length of the core, define cross-passageways for the flow of intake air therebetween. Although the present fin elements are primarily designed for use in a charge air cooler core construction, the present fin devices are adaptable for use with any heat exchanger device.

Heat transfer devices which utilize atmospheric air as one of the heat transfer agents are well known. In particular, a wide variety of charge air cooler core constructions have been designed and manufactured for use as heat exchangers in turbo-charged internal combustion engines. Typical of such heat exchanger core constructions is the tube and fin type construction wherein heat transfer is effected between one fluid medium flowing through the tubes and a second fluid medium such as air flowing externally over the tubes through the flow passageways formed by and between the fin structures. In designing and utilizing charge air cooler core assemblies, it is common practice to install the core assembly in a manifold housing in which both the manifold and the manifold cover associated therewith are configured to conduct the incoming air flow through the core assembly for the purpose of reducing the temperature of the incoming air to a desired temperature. It is also common practice that the air cooler core assembly be equipped with a circumferential mounting flange for supporting the core assembly in a manifold housing and the entire unit is then attached in some fashion to either the engine cylinder head or the engine block. Alternatively, the air cooler assembly may likewise be equipped with conventional mounting blocks, the mounting blocks including tapped holes adaptable for receiving cross-bolts or other fastener means for mounting the core assembly in a manifold housing. In either case, it is desirable that the manifold housing and the manifold cover associated therewith fit extremely tight against the sides of the air cooler core assembly thereby insuring maximum flow of charge air through the entire core assembly without leakage. Leakage of such air flow through the air cooler core sides is critical because it reduces the amount of direct heat transfer between the two fluid media thereby greatly reducing the thermal performance and overall efficiency of the heat exchanger unit.

Attainment of a complete air tight seal around the core assembly is extremely difficult to achieve. The manufacturing processes involved in fabricating the various core assembly components often times contribute to this problem. For example, since the manifold housings are made from a casting process, it is substantially impossible to maintain the required dimensional uniformity throughout the entire manifold cavity needed to insure an optimum air tight fit around the core assembly. In addition, the manifold cover also requires involved fabricating procedures such as making the member from either a casting process or a drawn steel fabrication process, both processes producing a cover which also lacks the dimensional accuracy necessary to insure an air tight seal around the heat exchanger core. Additionally, the manifold cover is generally made of a thin sheet of metal material and therefore requires substantial additional reinforcing beads to insure the structural integrity of the cover. These reinforcing beads are normally drawn and positioned so as to extend inwardly towards the core assembly when the manifold cover is positioned around the core unit and, even if such beads butt up against the encased core sides, the spaces formed between the core sides and the beads are sufficient to allow air to escape therethrough and pass around the core assembly. As a result, due to the air leakage problems associated with known methods for housing the core assembly, most heat exchanger units operate at reduced efficiencies and never achieve optimum heat transfer capability. These reduced efficiencies are normally caused by the combined effect of both the non-cooled intake air escaping through portions of the core sides and thereafter mixing with the cooled downstream air that does pass through the core assembly and a percent reduction in the actual mass velocity of the air passing through the core assembly due to these same air leakage problems, both of which have an adverse cumulative effect on the overall heat transfer performance of the heat exchanger unit.

The use of heat exchangers in an extremely wide range of industrial and commercial applications coupled with the highly desirable goals of energy conservation and fuel economy in all heat and energy related devices have resulted in a rapidly growing worldwide demand for the design of efficient, reliable and economical heat exchanger equipment. Although, in some cases, the required level of thermal performance for a particular engine or other device can still be maintained even with considerable air leakage past the heat exchanger core sides, as the demands for improved performance continue to increase, this by-pass or leakage of incoming air from the core sides becomes so detrimental to the performance of the charge air cooler that it must be controlled or eliminated. One means of at least minimizing this leakage of incoming air around and through the core sides is to mount core side plates adjacent to the respective core sides of the charge air cooler or other heat exchanger assembly. This method is widely used and has proven effective. However, the use of such additional side plates are undesirable in that these additional components add considerable cost and weight to the overall unit and such side plates are also subject to fatigue failure. Other means for reducing the loss of incoming air through the core sides have likewise been utilized, but all such endeavors have resulted in similar disadvantages and shortcomings. For these and other reasons, the known means for preventing the leakage of incoming air through the heat exchanger core sides have not been totally satisfactory.

The present air cooler core construction overcomes many of the disadvantages and shortcomings associated with known heat exchanger constructions, and teaches the construction and operation of a relatively simple core fin element having folded over side edges wherein, when said fins are placed in abutting relationship with adjacent fins as the core unit is assembled, the folded over fin side edges mate with one another to form a continuous, uninterrupted, air tight core side forming a controlled flow channel for the passage of air therethrough. In its preferred embodiment, the subject fin construction includes opposed folded over fin side edges having an offset portion associated respectively therewith adaptable to mate with, overlap, and interlock with the folded over side edges associated with adjacent fins. Alternative embodiments of the subject fin construction include folded over fin side edges which merely butt up against adjacent fins or, more desirably, overlap therewith. Interconnecting the folded over side edges of each respective fin element with its adjacent fin also serves to increase the structural strength of the overall core construction. This is important because the spaced apart fin elements utilized in most known core constructions are not interconnected in any manner whatsoever and such fins are often times bent or damaged during manufacturing, handling, and/or installation of the core assembly thereby even further decreasing the overall effectiveness and efficiency of the entire unit. This damage usually requires costly repair and rework of the entire unit and may even render the entire core assembly unacceptable from a functional and/or appearance standpoint. The present fin constructions, when assembled to form a core unit, substantially reduce this possibility of fin and/or core damage. Since one of the important functions of the folded over fin side edges is to increase the structural strength of the core unit and its mountings while, at the same time, eliminating the conventional core side plates normally employed and also to provide a complete sealing of the incoming air against leakage past a portion or portions of the air cooler core sides, structural integrity of the present simplified core construction may be even further increased by applying a suitable adhesive to the overlapping folded over fin side edges.

It is therefore a principle object of the present invention to provide a simple means for completely sealing the incoming air flow against leakage past a portion or portions of the air cooler core sides.

Another object is to provide an improved cooling fin construction that is structurally and operationally relatively simple and inexpensive.

Another object is to provide a cooling fin construction having folded over fin side edges adaptable for engaging an adjacent fin aligned therewith, the folded over side edges forming continuous, uninterrupted opposed core sides for allowing the controlled passage of air therebetween.

Another object is to provide a means for substantially minimizing the leakage of incoming air through the core sides while, at the same time, reducing the weight and cost of the overall core assembly.

Another object is to provide an improved cooling fin construction which provides structural strength to the core and its mountings while eliminating the use of conventional core side plates.

Another object is to provide an improved cooling fin construction wherein the folded over fin side edges overlap and interlock with adjacent fin side edges to form structurally sound, air tight core sides.

Another object is to provide an improved cooling fin construction wherein the folded over fin edges may be adhesively or metallurgically joined together to further increase structural integrity.

Another object is to provide a relatively simple core fin construction which can be economically produced for commercial use.

These and other objects and advantages of the present invention will become apparent to those skilled in the art after considering the following detailed specification which discloses several embodiments of the subject device in conjunction with the accompanying drawings, wherein.

Figure 12:
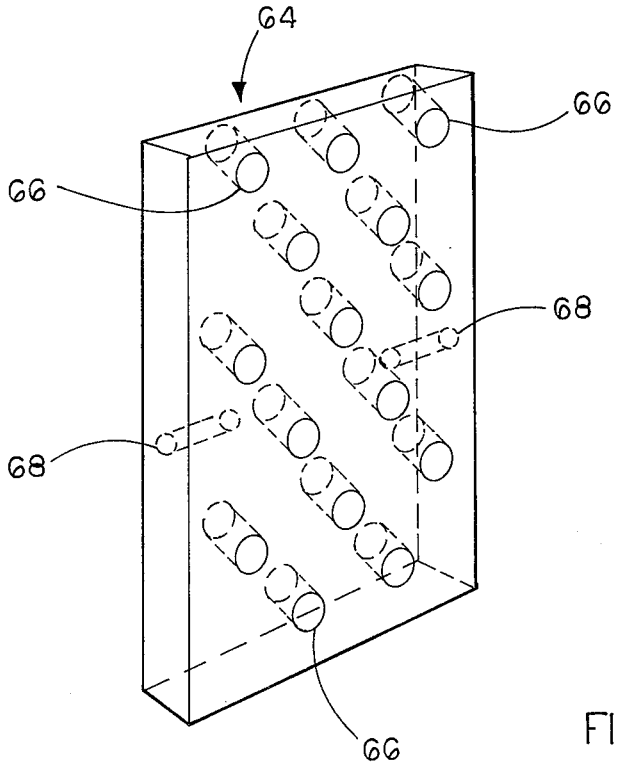
Figure 4:
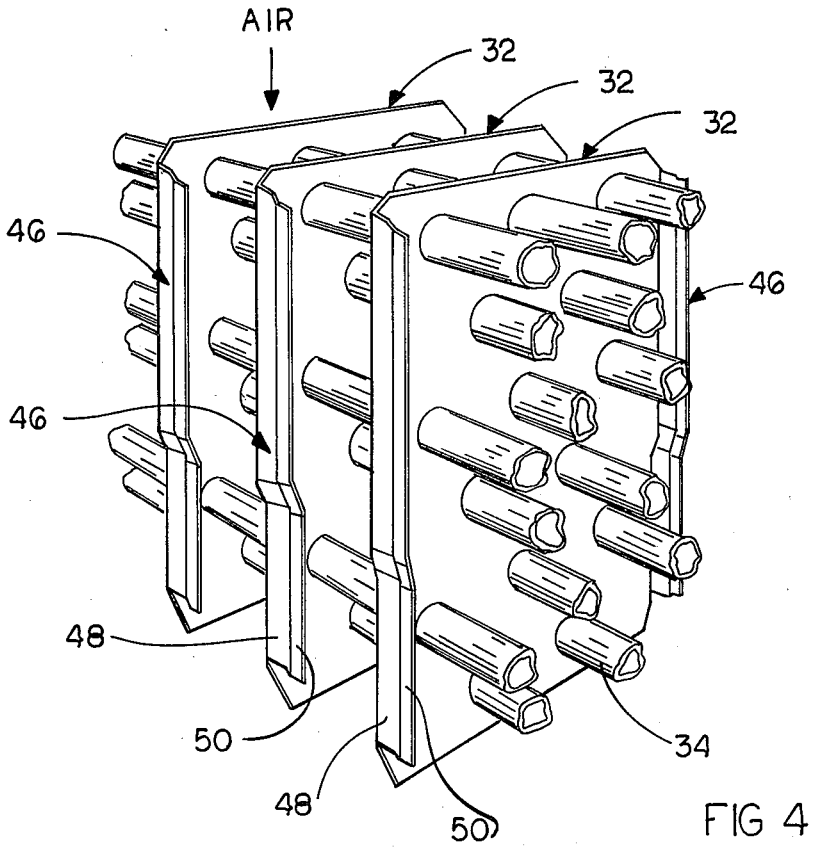
Figure 11:
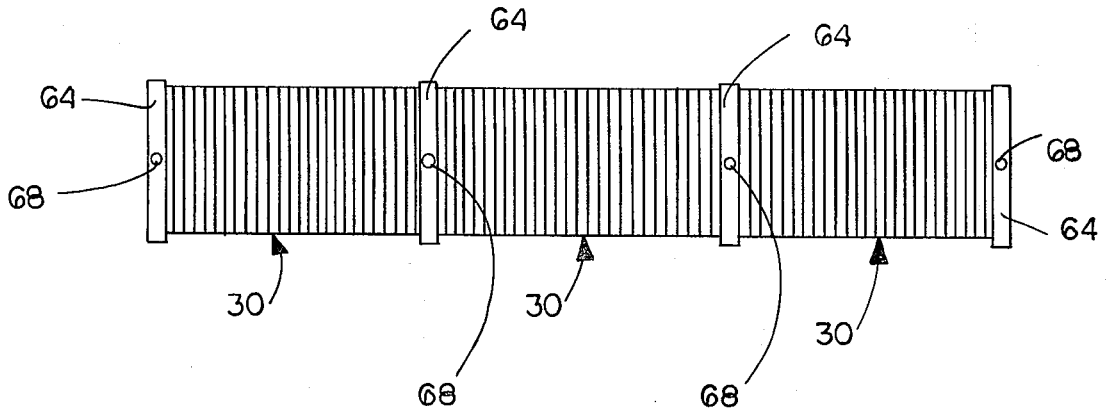
Figure 5:
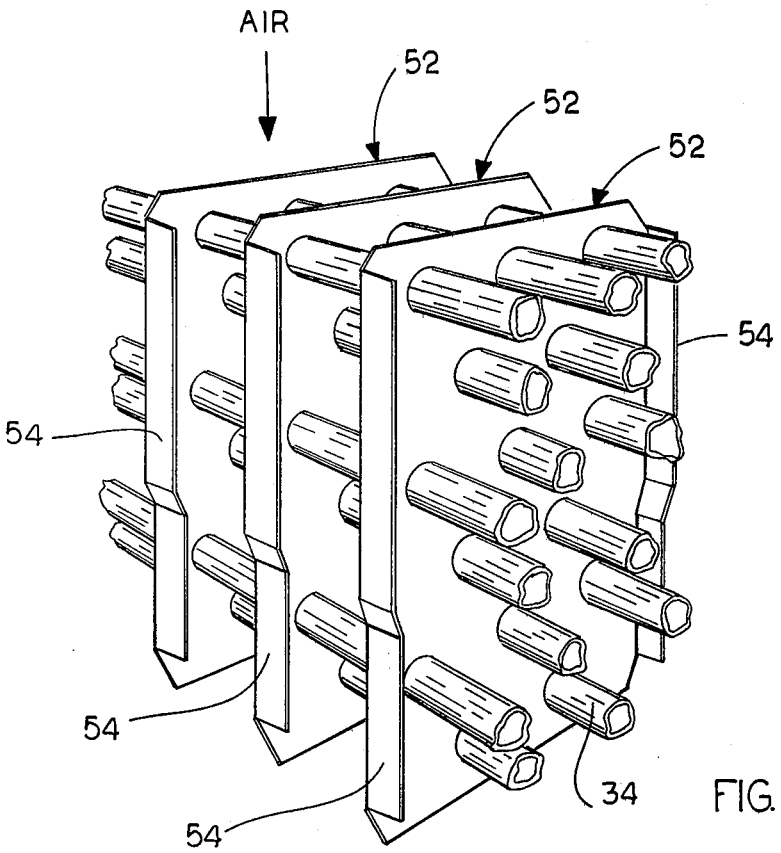
Figure 6:
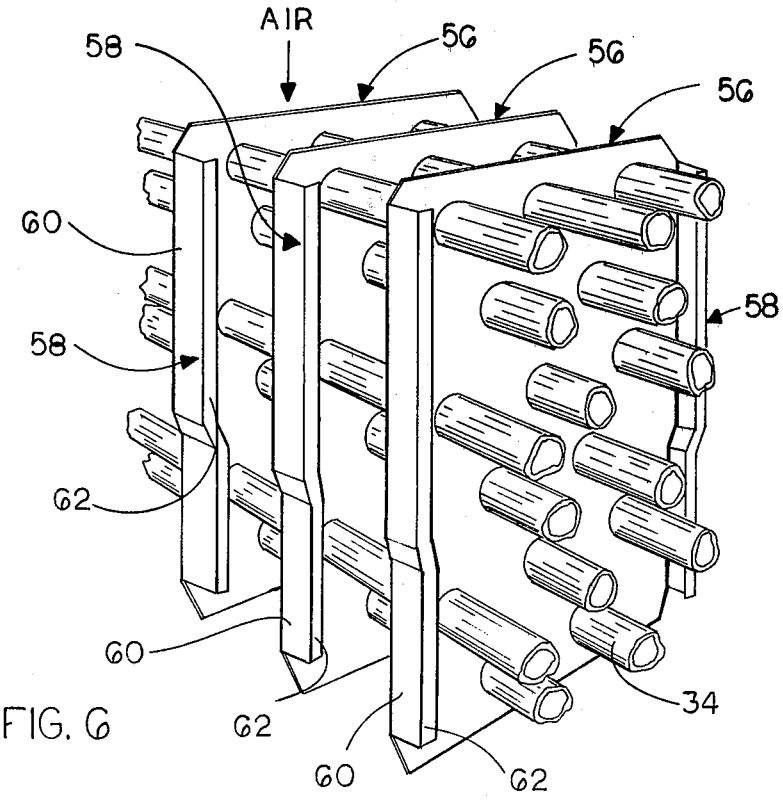
Figure 13:
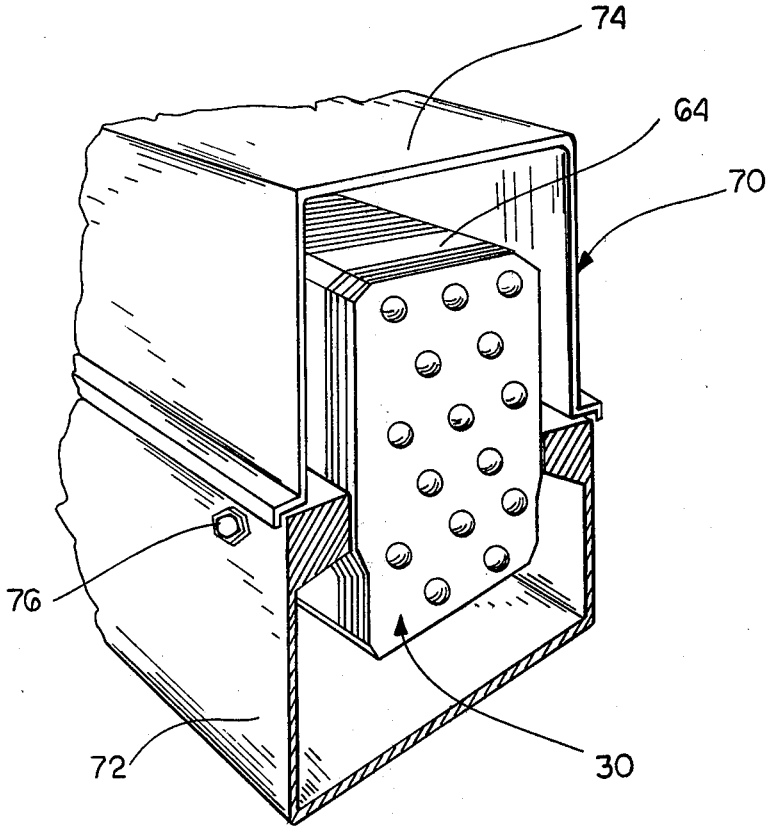

FIGS. 4, 5, and 6 are fragmentary exploded perspective views showing several different embodiments of the present cooling fin construction;

FIGS. 7, 8, 9, and 10 are partially enlarged cross-sectional views of the cooling fin embodiments of FIGS. 4, 5, and 6 showing the respective fin constructions in mating relationship with adjacent fins;

FIG. 11 is a side elevational view of a plurality of core assemblies integrated with conventional mounting blocks;

FIG. 12 is a perspective view of the mounting blocks shown in FIG. 11; and FIG. 13 is a partial perspective view showing an air cooler core assembly utilizing the present fin elements mounted within a typical manifold housing.

Figure 1:
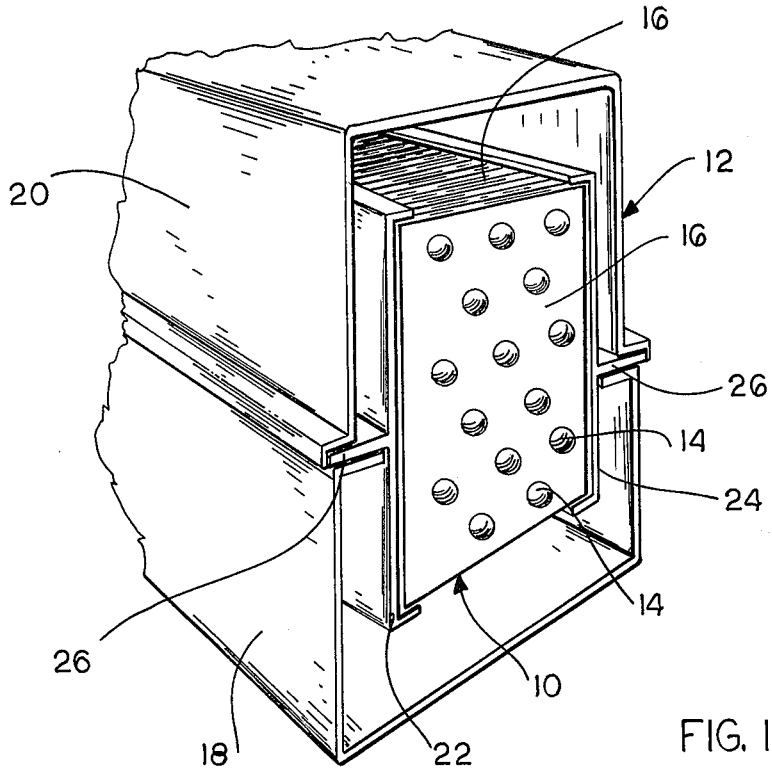
FIG. 1 is a partial perspective view of a conventional core assembly mounted within a conventional manifold housing.

Referring to the drawings more particularly by reference numerals wherein like numerals refer to like parts, number 10 in FIG. 1 illustrates a prior art heat exchanger core construction mounted within a conventional housing 12 which is designed to allow and conduct the incoming air flow through the core assembly in a conventional manner. The core assembly 10 is comprised of a plurality of tubes 14 which extend through and are bonded to a plurality of spaced apart fin elements 16 in a typical manner as will be hereinafter explained. The housing 12 includes a manifold 18 and a manifold cover 20 as previously discussed, the members 18 and 20 completely encasing the core assembly 10 as shown in FIG. 1. The core assembly 10 is also shown equipped with a typical pair of core side plates 22 and 24 which are mounted adjacent to the respective core sides as shown. The plates 22 and 24 are commonly used in an effort to minimize the leakage of incoming air around and through the core sides as previously explained and each includes a circumferential flange 26 for attaching to the manifold members 18 and 20. As already discussed, the core side plates 22 and 24 add considerable weight and cost to the overall unit and these additional components are also subject to fatigue failure due to the high temperatures and other stress factors associated with the operating environment.

Figure 2:
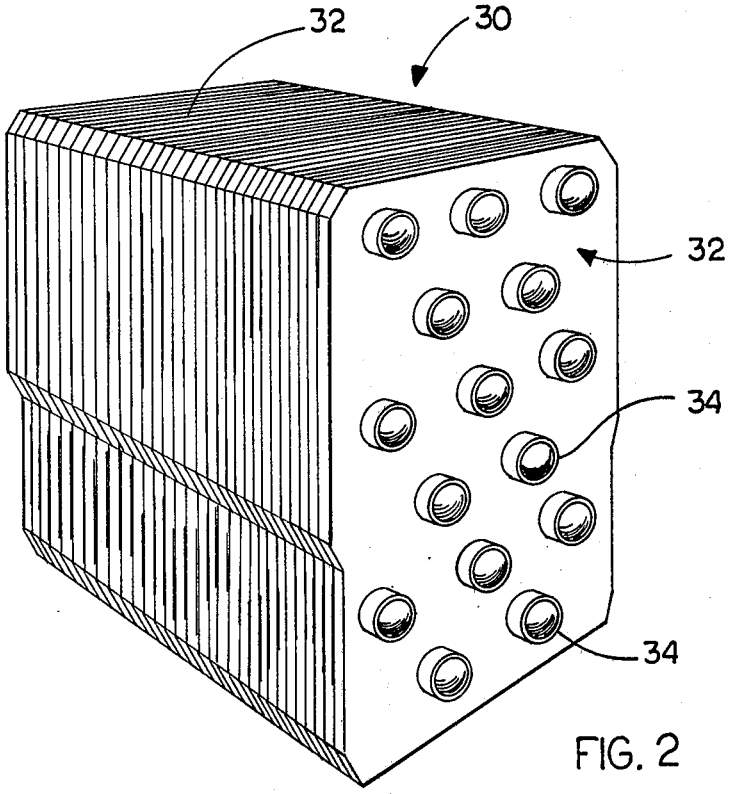
FIG. 2 is a perspective view of a charge air cooler core assembly having a plurality of cooling fins constructed and connected together according to the teachings of the present invention.

FIG. 2 illustrates a charge air cooler core construction 30 having a plurality of cooling fins 32 constructed and connected together according to the teachings of the present invention. The core assembly 30 is generally of an elongated rectangular shape and is comprised of a plurality of tubular members 34 which extend through and are connected to the plurality of interconnected fin structures 32, as will be hereinafter explained, to achieve a cross-flow pattern of fluid distribution therethrough whereby two fluid media pass through the core assembly 30 in heat exchange relationship with each other. The fins 32 are disposed in spaced apart parallel relationship with each other and each pair of fins 32 defines a passageway therebetween for allowing a fluid medium such as air to flow therethrough. The fin elements 32 are provided to increase the effective heat transfer surface and when air is directed between the fins 32 and over the tubes 34, a transfer of heat occurs between the flowing air and the fluid medium flowing through the tubes. It should be noted that all of the structural members comprising the core structure 30, namely, the fin structures 32 and the tubular members 34, are formed of a suitable heat conducting metal such as aluminum, copper and/or copper clad, and such fin and tube members are conventionally joined together by any suitable bonding means such as by soldering, crimping, and/or brazing to form the unitized core structure. The specific type of bonding utilized may vary depending upon the particular application of the heat exchanger unit. Suitable manifolding (not shown) is also provided at each opposite end portion of the core assembly for directing the two fluid media through their respective flow passageways formed within the core assembly. Although the present fin structures 32 are shown and disclosed in conjunction with a tube and fin type heat exchanger construction, it is recognized that the subject fin devices 32 are easily and conveniently adaptable for use in any heat exchanger core assembly.

Figure 3:
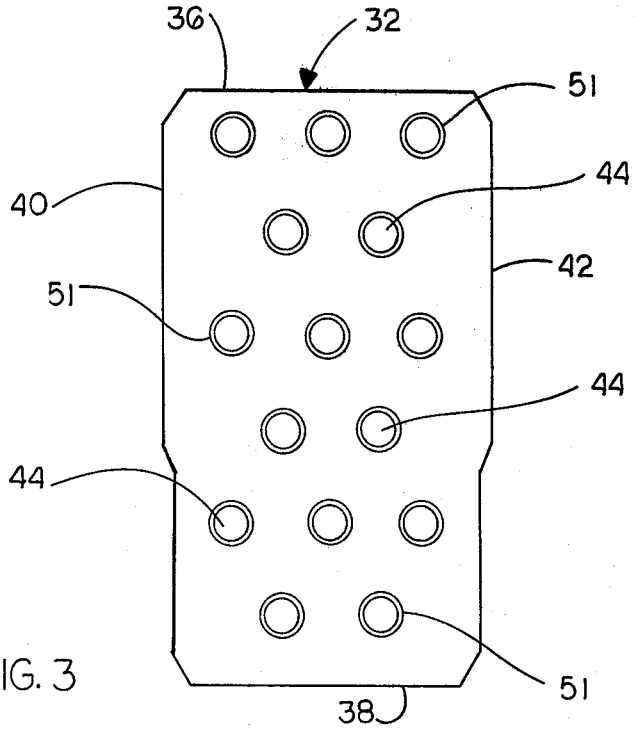
FIG. 3 is a top plan view of one of the cooling fins shown in FIG. 2.
Figure 7:
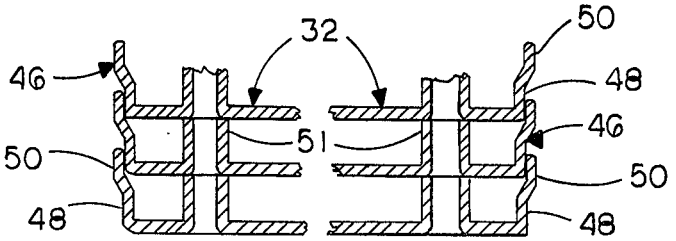

FIG. 3 discloses a top plan view of the present fin structure 32 which is common to all embodiments of the present invention hereinafter discussed. The fin structure 32 is shown as being substantially rectangular in shape and includes opposed top and bottom edges 36 and 38 and opposed side edges 40 and 42. The fins 32 are generally of a one-piece planar construction and also include a plurality of openings 44 adaptable for receiving the tubular members 34 therethrough. In its preferred embodiment, the side edges 40 and 42 of the fins 32 each include a folded over flange portion 46 as shown in FIGS. 4 and 7. The flange portions 46 are positioned so as to extend longitudinally in a direction substantially parallel to the direction of air flow through the core assembly 30 and each flange 46 includes a base portion 48 and an offset portion 50 as best shown in FIG. 7. The fin elements 32 are specifically designed to fit one inside the other and, when stacked one upon the other as the core unit is assembled, the offset portions 50 cooperatively engage the base portions 48 of the adjacent fin (FIG. 7) so as to hold the adjacent fin in tight engagement therewith. As a plurality of fin elements 32 are stacked one upon the other, the folded over side flanges 46 form a continuous, uninterrupted core side on each opposite side thereof which together form a controlled flow channel for the passage of air therethrough and substantially prevent the incoming non-cooled air from escaping therethrough.

Each fin element 32 also includes a circumferential flange or annular collar 51 extending outwardly from around each of the openings 44 as best shown in FIGS. 7–10. The collars 51 extend longitudinally in a direction away from the planer surface of the fin and parallel to the folded over flange portions 46 and each collar 51 serves as a means for separating and maintaining the required spacing between adjacent fin elements when stacked one upon the other to form the core unit. During assembly of the core unit, the tube members 34 are positioned through the openings 44 located on the respective fin elements 32 and the fin elements 32 are thereafter placed in abutment with each other such that the upper portion of each collar 51 presses against the adjacent fin element as shown in FIG. 7. This self-spacing feature is quite common in the industry and use of the collars 51 are highly desirable for controlling the spacing between adjacent fin elements. It is recognized that the height of the individual collars 51 may be varied depending upon the desired spacing.

Once adjacent fin elements 32 are placed in mating relationship with each other as previously described, the offset flange portions 50 overlap and interlock with the base portions 48 thereby forming a core side having sound structural integrity. The mere fact that the fins 32 overlap and interlock with each other produces a stronger core unit as compared to the known prior art and this arrangement keeps the individual fin elements from fluctuating and moving due to the turbulence and pulsations created by the incoming air impinging upon the fin surfaces. The folded over side flanges 46 also extend the surface area of the fin and provide additional heat transfer area without increasing the envelope of the core or the fin density within the core. This increases the overall efficiency and effectiveness of the heat exchanger unit without adding additional components or weight. It should also be noted that the width of the offset portions 50 may likewise be varied depending upon the amount of overlap and structural integrity desired.

Use of the present fin elements 32 with the folded over side flanges 46 provides an effective and efficient means for substantially preventing leakage of incoming air through the core sides and it eliminates the use of additional core side plates such as the plates 22 and 24 (FIG. 1) which, as indicated, add considerable cost and weight to the overall core assembly. The structural integrity of the core sides formed by the interlocking flange portions 46 may likewise be substantially increased by applying a suitable adhesive to the overlapping fin edges 46. Any of the well known high-temperature, high-performance adhesives will work in the practice of this invention. A particular adhesive suggested for this application is a two part thermosetting epoxy resin such as the EPK 6C epoxy resin marketed by Hysol Corporation. Another suitable adhesive which may also be utilized in the practice of this invention is the 2214 high temperature one part thermosetting epoxy resin marketed by 3M Corporation. Although these adhesives are generally preferred, industrial grade epoxy adhesives compatible with the base metal of the fin structure and the operating environment associated therewith would likewise be usable. Other high-performance adhesives may be made from polycarbonates, nylons and certain high performance polyesters. Painting the assembled core unit 30 in a conventional manner with known paints compatible with the base metal of the core unit will likewise insure the integrity of the seal between the overlapping fin edges 46.

Figure 8:
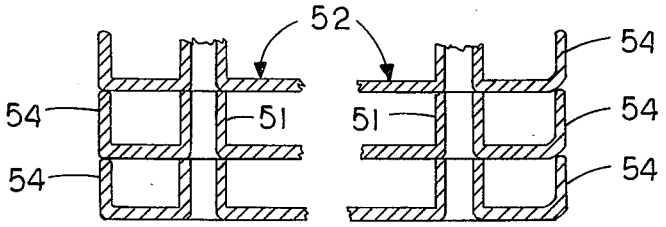

FIGS. 5 and 8 disclose another embodiment of the present fin construction wherein the fin elements 52 include folded over flange portions 54 located on each opposite side edge thereof as best shown in FIG. 8. Like the fin elements 32, the fin structures 52 are similarly constructed and likewise include a plurality of openings adaptable for receiving the tubular members 34 therethrough. The flange portions 54, like the folded over flange portions 46, extend substantially perpendicular to the planar surface of the fin and likewise extend longitudinally in a direction substantially parallel to the direction of air flow through the core assembly. The fins 52 are likewise made so as to fit one inside the other and when the fins 52 are stacked one upon the other as the core unit is being assembled, the flanges 54, unlike the flanges 46, do not overlap each other but instead merely butt up against the adjacent fin member on each opposite side thereof as shown in FIG. 8. The fins elements 52 are held in this abutting relationship by suitably bonding the fins to the tubular members 34 as previously described. Once bonded, the abutting side flanges 54 likewise form a continuous, uninterrupted, air tight core side on each opposite side of the assembled core unit for allowing the passage of air therethrough without leakage. Like the flange portions 46, the abutting flanges 54 may likewise be adhesively joined together as previously indicated to further increase the structural integrity of the core sides and the overall core unit. Although the fin elements 32 are generally preferred, the fin members 52 work equally as well in forming a suitable air tight seal and preventing leakage of the incoming air flow through the core sides.

Figure 9:
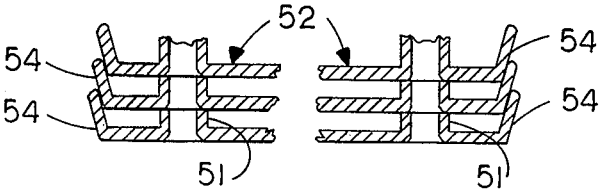

FIG. 9 discloses an enlarged partial cross-sectional view of a core assembly similar to the assembly disclosed in FIG. 8 wherein the adjacent fin elements 52 (FIGS. 5 and 8) are mated and connected together according to an alternative method for joining said members. Instead of merely butting together the respective flange portions 54 as shown in FIG. 8, an overlap condition may be achieved by placing the fin elements 52 in abutting relationship one inside the other as previously explained and thereafter further compressing the fins 52 together so as to force the folded over flanges 54 outwardly into an overlapping condition with the adjacent fin member as shown in FIG. 9. The application of this additional compressing force on each respective fin element 52 allows the side flanges 54 associated with one fin member to ride up and over the side flanges associated with the adjacent fin member thereby producing a core unit wherein the flanges 54 are forcibly pushed outwardly into tight overlapping engagement with each other. This method of forcibly overlapping the side flanges 54 produces a structurally stronger core unit as compared to merely placing the folded over flanges 54 in abutting relationship with each other as shown in FIG. 8. Like the flanges 46, the width of the folded over side flanges 54 may also be varied to achieve the desired amount of overlap. In addition, any suitable adhesive means, as previously described, may likewise be applied between the overlapping side flanges 54 (FIG. 9) to add additional strength and rigidity to both the core sides and the entire core assembly. Additionally, it should be noted that if the fin elements 52 are to be mated and interconnected as shown in FIG. 9, it may be necessary to adjust the height of the collars 51 so as to produce the desired spacing between adjacent fins after the desired overlap between the flanges 54 has been achieved.

Figure 10:
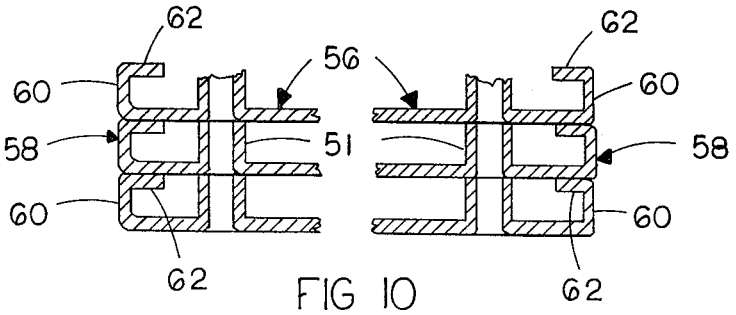

FIGS. 6 and 10 disclose still another embodiment of the present fin devices wherein the fin elements 56 are likewise constructed similarly to the fin elements 32 and 52 and each fin 56 includes folded over side flanges 58 located on each opposite side edge thereof as best shown in FIG. 10. The flanges 58 each include a side portion 60, similar to the flange portions 46 and 54, which extends longitudinally in a direction substantially parallel to the direction of air flow through the core assembly and another flange portion 62 which lies substantially perpendicular to the side portion 60 and extends inwardly therefrom in a direction towards the center of the fin element 56. The flange portions 62 are preferably integrally formed with the flange side portions 60 and each lies in a plane substantially parallel to the planar surface of the fin. The fins 56 are specifically designed to rest one on top of the other and, when so positioned, the flange portions 62 abut the bottom surface of the adjacent fin member (FIG. 10) and are thereafter held in this abutting configuration by suitably bonding the fins to the respective tube members as previously explained. Once bonded, the abutting flanges 58 and, more particularly, the side portions 60 form a continuous air tight core side on each opposite side of the core unit for preventing the leakage of incoming air therethrough. Use of the additional flange portions 62 provide a firm foundation upon which an adjacent fin member can rest and, when the fins 56 are stacked one upon the other as shown in FIG. 10, the flange portions 62 provide sufficient interface with the adjacent fin members so as to add additional strength and stability to the overall core unit. The size of the flange portions 62 may also be varied to achieve the desired amount of interface with adjacent fins. In addition, like the collars 51, the length of the flange side portions 60 may also be utilized to control and maintain the desired spacing between adjacent fin members 56. Additionally, the abutting flanges 58 and, more particularly, the flange portions 62 may likewise be adhesively joined together to further increase the structural integrity of the core sides and the overall core unit.

It is important to note that the overall length of each core assembly such as the core assembly 30 (FIG. 2) is subject to wide variations and the total number of individual fin elements incorporated therein will depend on the particular application and utilization to be made of the particular heat exchanger device. In discussing the various embodiments of the present invention, it is to be understood that any number of individual core assemblies such as the core assemblies 30 may likewise be advantageously interconnected to one another as required to form any desired length as shown in FIG. 11. This enables the employment of an arrangement of core assemblies to suit a particular need and increases the usefulness of the present devices. This interconnection of a plurality of core assemblies may be accomplished by using tubular members which extend through a conventional mounting block such as the mounting block 64 between each adjacent core assembly as shown in FIG. 11. The mounting blocks 64 are preferably made of a one-piece metal construction and each generally conforms to the overall size and shape of the individual fin elements utilized within the individual core assemblies. Like the fin elements 32, 52, and 56, the mounting blocks 64 likewise include a plurality of openings 66 adaptable for receiving the tubular members such as the members 34 therethrough. The openings 66 are positioned and arranged so as to register with the openings 44 associated with each of the respective fin elements when positioned adjacent thereto. The mounting blocks 64 also include a tapped hole 68 on each opposite side thereof (FIG. 12) adaptable for receiving a cross-bolt or other fastener means for mounting the entire heat exchanger unit to a manifold housing or other engine component as will be hereinafter discussed.

Since use of the present fin devices eliminates the use of the conventional core side plates such as the plates 22 and 24 and the circumferential mounting flange 26 normally associated therewith (FIG. 1), the mounting of core units utilizing the present fin devices cannot be accomplished as shown in FIG. 1. However, use of the mounting blocks 64 provides a simple means for mounting such a unit in a conventional manifold housing. FIG. 13 illustrates how such a heat exchanger core unit would be mounted within a conventional housing 70. The housing 70 includes a manifold 72 and a manifold cover 74 which together completely encase the entire heat exchanger core assembly. Besides having the mounting blocks 64 positioned between adjacent core assemblies, it is also advantageous to position the mounting blocks on each opposite end of the entire core unit as shown in FIG. 11. This greatly facilitates mounting and provides support for each end portion thereof. The entire unit is then easily mounted within the housing 70 by inserting cross-bolts or other fastener means such as the threaded members 76 through openings (not shown) in the manifold 72 and thereafter threadingly securing the members 76 into the tapped holes 68 on each opposite side of the mounting blocks 64. The threaded members 76 are positioned within the tapped holes 68 associated with each of the mounting blocks 64 and should be of sufficient size to adequately support the entire heat exchanger unit depending upon its overall weight. The length of the individual core assemblies 30 and the total number of mounting blocks 64 utilized for a particular heat exchanger unit will vary depending upon the size and weight of the finished unit. It should be noted that a sufficient number of mounting blocks should be utilized to adequately support the device within the manifold housing.

Although those embodiments of the present fin construction which achieve an overlapping and/or interlocking relationship with adjacent fins are generally preferred, the mated together, folded over side flanges associated with each of the fin embodiments hereinbefore disclosed provide a structurally sound, air tight core side on each opposite side of the core assembly for substantially minimizing and/or preventing the leakage of incoming air therethrough while, at the same time, reducing the overall weight and cost of the entire heat exchanger unit. As previously discussed, all embodiments of the present fin devices add additional heat transfer area to the fin without increasing the size and/or shape of the core assembly or the fin density within the core while, at the same time, increasing the structural integrity of the overall core unit. The mere fact that the folded over side flanges on each of the respective fins mate with each other in either an abutting, overlapping, and/or interlocking relationship enhances the core strength and substantially prevents the individual fin members from fluctuating and moving due to the turbulence and pulsations created by the flow of incoming air therebetween. It is also anticipated that the individual fin elements 32, 52 and 56 may likewise include means on at least one surface thereof such as various shaped corrugations, louvers and other boundary layer reduction or disturbance devices for directing at least a portion of the incoming air flow over and around the tubes extending therethrough. In addition, it is also recognized that the overall size and shape of the individual fin elements may be conveniently fashioned into a variety of sizes and configurations, for example, a triangular, rectangular, hexagonal, circular, or other configuration, so as to be compatible with the size and shape of the manifold housing into which it will be mounted or to conform with any other space limitations without impairing the teachings and practice of the present construction. Although the present fin elements are primarily designed for substantially preventing the leakage of incoming air through the core sides, the present fin devices are also easily adaptable for use with other fluid media. The simplicity, durability, flexibility and versatility of the present fin devices greatly increases its usefulness and effectiveness in a wide variety of heat exchanger applications.

Thus there has been shown and described several embodiments of a novel fin configuration for use in heat exchanger core assemblies, which fin constructions fulfill all of the objects and advantages sought therefor. Many changes, modifications, variations, and other uses and applications of the present constructions will, however, become apparent to those skilled in the art after considering this specification and the accompanying drawings, and all such changes, modifications, variations, and other uses and applications which do not depart from the spirit and scope of the invention are deemed to be covered by the invention which is limited only by the claims which follow.

What is claimed is:

1. A heat exchanger core assembly adaptable for allowing the passage of air therethrough comprising a plurality of spaced apart substantially parallel fin elements having a plurality of apertures extending therethrough, a plurality of substantially parallel tubular members adaptable for receiving and carrying a fluid member therethrough extending through the apertures in said fin elements defining an array of longitudinally and laterally disposed rows of tubular members, each pair of said fin elements defining a passageway therebetween for allowing air to flow therethrough, said fin elements having first and second opposed side portions extending in a direction substantially parallel to the direction of air flow through said core assembly, each of said fin elements including a folded over side edge extending along each of said first and second opposed side portions, said folded over side edges being adaptable for overlapping the folded over side edges of an adjacent fin element when said fin elements are positioned in close abutting relationship with each other, said overlapping side edges being adhesively joined by an adhesive selected from the group consisting of an epoxy resin, a polycarbonate, a nylon and a polyester and forming a substantially air tight continuous core side on each opposite side of said plurality of fin elements for substantially preventing the leakage of air through the core sides.

2. The heat exchanger core assembly defined in claim 1 wherein the folded over side edges of said fin elements include means for cooperatively engaging the folded over side edges of an adjacent fin element when said fin elements are placed in an overlapped condition.

3. The heat exchanger core assembly defined in claim 1 wherein said fin elements include means extending from at least one surface thereof for maintaining the required spacing between adjacent fin elements.

4. The heat exchanger core assembly defined in claim 3 wherein said spacing means extending from at least one surface of each of said fin elements includes a circumferential flange extending around the plurality of apertures associated with each of said fin elements, said circumferential flanges abutting the opposite surface of the next adjacent fin element when the folded over side edges of said fin elements are placed in overlapping relationship with each other.

5. The heat exchanger core assembly defined in claim 1 wherein said fin elements are generally rectangular in shape and are formed of a suitable heat conducting material.

6. The heat exchanger core assembly defined in claim 1 wherein said fin elements include means on at least one surface thereof for directing at least a portion of the air flow over said fin elements and around the tubular members extending therethrough.

7. The heat exchanger core assembly defined in claim 6 wherein said means for directing at least a portion of the air flow over said fin elements and around the tubular members extending therethrough includes corrugations on said fin element surface.

8. The heat exchanger core assembly defined in claim 1 wherein said adhesive is an epoxy resin.

9. A heat exchanger core assembly adaptable for allowing the passage of air therethrough comprising a plurality of substantially parallel tubular members extending longitudinally through said core assembly, the plurality of spaced apart fin elements having a plurality of openings extending therethrough adaptable for receiving said tubular members, said tubular members being disposed through said fin openings and adaptable for receiving and carrying a fluid medium therewithin, said fin elements being disposed in a substantially parallel relationship with each other and each pair of said fin elements defining a passageway therebetween for allowing air to flow therethrough, each of said fin elements having opposite side edges extending in a direction substantially parallel to the direction of air flow through the core assembly and each including a folded over side portion extending along each of said opposite side edges, said fin elements being stackable one upon the other such that the folded over side portions of one fin element abut the adjacent fin element aligned therewith on each opposite side thereof, said folded over side portions being respectively adhesively joined to said adjacent fin element by an adhesive selected from the group consisting of an epoxy resin, a polycarbonate, a nylon and a polyester, said folded over side portions forming a substantially air tight continuous core side on each opposite side of said plurality of fin elements when said fin elements are stacked one upon the other thereby substantially preventing the leakage of air therethrough.

* * * * *